United States Patent [19]

Aoki et al.

[11] 4,119,409

[45] Oct. 10, 1978

[54] PROCESS FOR THE PREPARATION OF SYNTHETIC COKING COAL

[75] Inventors: Yutaka Aoki, Tokyo; Akira Hase, Kawasaki; Jiro Ito, Kamakura; Hisomu Nagai, Tokyo, all of Japan

[73] Assignee: Nissho-Iwai Co., Ltd., Tokyo, Japan

[21] Appl. No.: 799,165

[22] Filed: May 23, 1977

[30] Foreign Application Priority Data

May 27, 1976 [JP] Japan ..... 51/60563

[51] Int. Cl.[2] ..... C10L 5/48

[52] U.S. Cl. ..... 44/1 R; 44/1 B; 44/1 G

[58] Field of Search ..... 44/1 R, 1 F, 1 G, 10 D, 44/1 C, 1 B

[56] References Cited

U.S. PATENT DOCUMENTS

| | | | |
|---|---|---|---|
| 3,341,447 | 9/1967 | Bull et al. | 208/8 |
| 3,933,443 | 1/1976 | Lohrmann | 44/1 F |
| 3,980,447 | 9/1976 | Franke et al. | 44/10 D |

*Primary Examiner*—Carl Dees

*Attorney, Agent, or Firm*—Stevens, Davis, Miller & Mosher

[57] ABSTRACT

Synthetic coking coal is prepared by mixing solvent refined coal with coal and heat-treating the resulting mixture at a temperature ranging from about 300° C to about 480° C, preferably from about 380° C to about 450° C.

10 Claims, No Drawings

PROCESS FOR THE PREPARATION OF SYNTHETIC COKING COAL

BACKGROUND OF THE INVENTION

1. Field of the Invention

This invention relates to a process for the preparation of synthetic coking coal using solvent refined coal.

As is well known, coking coal is essential to the production of coke for iron manufacture and the demand therefor is very high as iron production is increasing at the present time. However, the world-wide reserves of hard coking coal are very limited as compared with non-coking or soft coking coal reserves, and they are becoming exhausted. Thus, to deal with this problem, the utilization of non-coking coal, soft coking coal or other low coalified materials which are found in relatively abundant quantities is strongly desired, and many efforts for manufacturing synthetic coking coal from such low coalified materials have been made. This invention provides one method therefor.

2. Description of the Prior Art

As a reformed coal from low quality coals, solvent refined coal (SRC) is known, as disclosed, for example, in U.S. Pat. No. 3,341,447 and in "Research and Development Report No. 9, *Solvent Processing of Coal to Produce a De-Ashed Product*", the Department of the Interior, Office of Coal Research (presently the Energy Research and Development Administration).

According to this patent and report, SRC is a low ash-low sulfur product obtained from solvent extraction of coal under hydrogen pressure, wherein the coal is generally subjected to hydrocracking at a temperature of about 400° C. under a pressure of about 100 atm. in the presence or absence of a catalyst, such as Co—Mo or Fe based catalyst, and the non-dissolved residue is removed from the hydrocracked product (the de-ashing step).

Practical application of SRC is now under study and industrial production thereof has not yet begun. However, in the light of its excellent qualities, particularly its low ash-low sulfur content, it is expected that SRC will, in the near future, obtain wide acclaim as a clean fuel.

Ordinarily, SRC has the following general composition and properties:

| Ultimate Analysis | |
|---|---|
| Items | Percent by Weight |
| Carbon (C) | 85–94 |
| Hydrogen (H) | 4.0–6.5 |
| Nitrogen (N) | 0.5–20 |
| Oxygen (O) | 1.0–5.0 |
| Sulfur (S) | 0.1–1.0 |
| O/C Atomic Ratio | 0.015–0.040 |
| Proximate Analysis | |
| Items | Percent by Weight |
| Fixed Carbon | 41–45 |
| Volatile matter | 55–58 |
| Ash content | 0.1–0.5 |
| Properties | |
| Softening point | 85–150° C |

From the above, the features of SRC are summarized as follows:

(1) SRC has a high carbon content of about 85–94% by weight which is comparable to that of coking coal, and its O/C atomic ratio is lower than 0.04.

(2) SRC has higher hydrogen content, higher volatile matter and lower oxygen content than ordinary coal.

(3) SRC has a softening point of about 100° C. or so.

(4) From any types of starting coal material (for example, even from low quality material such as brown coal), SRC products of similar composition or properties can be obtained. (This is more specifically described hereinafter with respect to Table I).

From the above analysis, it can be seen that SRC is considerably different from natural hard coking coal in that the former has a higher volatile matter and a lower softening point, as compared with the latter. Some examples of ordinary starting coals for the production of metallurgical coke are shown as follows:

| Brand | Volatile matter (wt. %) | CSN | Initial Melting Point(° C) |
|---|---|---|---|
| Itmann (U.S.A.) | 16–19 | 7–9 | 427 |
| Wyco (U.S.A.) | 16–18 | 8–9 | 403 |
| Moss No. 3 (U.S.A.) | 26–28 | 8–9 | 355 |
| South Bullli (Australia) | 21–23 | 5–6 | 410 |
| Liddell (Australia) | 37–39 | 5–6 | 385 |
| Akabira (Japan) | 40–42 | 4–5 | 334 |

Thus, it is difficult to use SRC itself in the production of coke for iron manufacturing, but if its volatile matter is lowered and its softening point is raised by means of any suitable technique, it may be expected that a good coking material having quality equivalent to that of natural coking coal can be obtained. This invention is based on such consideration.

SUMMARY OF THE INVENTION

It has now been found that good coking carbonaceous material having a quality equivalent to that of natural coking coal can be produced by mixing solvent refined coal with coal and heat-treating the mixture at a temperature of from about 300° C. to about 480° C. preferably from about 380° C. to about 450° C. According to the present invention, synthetic high quality coking coal can be easily produced from low priced and abundant low-coalified materials.

DETAILED DESCRIPTION OF THE INVENTION

According to the present invention, there is provided a process for the preparation of synthetic coking coal which comprises mixing solvent refined coal with coal and heat-treating the resulting mixture at a temperature of about 300° C.–480° C., preferably about 380° C.–450° C.

The solvent refined coal, i.e., SRC used in the present invention is any material having a general composition and properties as mentioned hereinbefore, and is known per se. In addition, it is not always necessary for SRC to be deashed, for the purpose of the present invention, while so-called SRC is a deashed product from coal.

This is because cokes which are currently used for iron-manufacturing have ash content of about 10% by weight or more, and thus SRC containing ash to some extent can also give a desired coke without any trouble.

In the present invention, "coals" to be added to SRC (hereinafter, referred to "additive coal") include non-coking coals such as lignite, brown coal, sub-bituminous coal and anthracite, and coking coals such as weak-coking coal, soft coking coal, and hard coking coal. Preferred additive coals are weak and soft coking coal.

Said SRC and additive coals are preferably used in a granular or powdery form, and the particle size thereof is generally less than about 1 mm, preferably less than 28 mesh.

In the present invention, the SRC and the additive coal are mixed in a proportion of about 1:0.25–4, preferably about 1:0.5–2 (as weight ratio).

The heat-treatment according to the present invention is generally effected at a temperature within the range of about 300° C. to about 480° C., preferably about 380° C.–450° C. Temperatures of this range are generally between the softening or initial melting temperature and solidification temperature of the preferred additive coal i.e. coking coal. Thus, when a coking coal such as weak coking or soft coking coal is used as the additive coal, the heat treatment of the SRC-additive coal mixture is performed in a state wherein the SRC and additive coal are both melted.

However, according to the present invention, when non-coking coal such as brown coal which is not thermally melted is used as the additive coal, the desired good coking material can also be obtained by heat-treatment in the above temperature range, particulary within the preferred temperature range.

We cannot theoretically explain the reason why the desired effect is achieved by the heat-treatment of the mixture of SRC and additive coal at said specific temperature range. The present invention is based merely on the fact that the actual desired effect can be obtained by mixing SRC with additive coal and heat-treating the mixture at a temperature between about 300° C.–480° C., preferably about 380° C.–450° C.

The heat-treating time is generally about ½–7 hours, preferably 1–2 hours. Also, the heat-treatment according to the present invention may be effected under atmospheric pressure or pressure of up to about 10 atm.

According to the present invention which is carried out as mentioned above, good quality coking carbonaceous products having volatile matter contents of about 15–35% preferably 18–30% and softening point of more than about 300° C. can be formed from SRC and ordinary coal stock. These products are fully comparable to natural coking coal which is usually employed as a starting material for the production of coke for iron manufacturing.

Particularly, the essential advantage of the present invention is that good quality synthetic coking material can be obtained even from low quality additive coals, e.g., non-coking coal such as brown coal or sub-bituminous coal, and weak or soft coking coal. This fact and the fact that SRC itself starts from low quality coal constitute a great economical advantage in the art. Of course, the use of good quality coal such as coking coal as the additive coal is also effective but the economical merit thereof is not so high. However, we believe that in the present invention, the additive coal itself is also reformed by SRC. Thus, it will be expected that coals with low fluidity such as Canadian or Australian hard coking coal can be reformed in their fluidity according to the process of the present invention.

The synthetic coking coal prepared according to the process of the present invention may be employed for the production of metallurgical coke, as is, but preferably, it is mixed together with ordinary natural coking coal to produce coke for iron manufacturing.

The type of coking coal to be mixed and the added amount thereof depend on the properties desired of the synthetic coking coal prepared according to the present invention. In turn, a synthetic coking coal having properties compatible with a natural coking coal to be mixed therewith may be produced according to the present invention.

In summary, according to the present invention, good quality metallurgical coke can be easily and economically prepared from any type of coal, by properly selecting (1) the properties of the SRC, (2) the type and amount of additive coal, (3) the conditions of heat treatment and (4) the type of natural coking coal used in the production of coke (if necessary).

The present invention is now described in detail by way of some preferred examples. Unless otherwise specified, all percentages and parts are by weight in the examples.

As described hereinbefore, the SRC to be used in the present invention is now under study. Thus, since it was commercially unavailable, we obtained three trial maufactured SRC samples which were prepared in the laboratory according to the procedure as mentioned hereinbefore and used then in the examples. These three SRC samples are shown in Table I below:

Table I

The Properties of SRC used in the Present Invention

| Sample | Ultimate Analysis (% by weight) C | H | N | O | S | O/C Atomic Ratio | Proximate Analysis(% by weight) Ash Content | Volatile Matter | Fixed Carbon | Softening Point (° C) |
|---|---|---|---|---|---|---|---|---|---|---|
| A | 88.4 | 5.6 | 2.0 | 3.4 | 0.5 | 0.038 | 0.3 | 55.0 | 44.7 | 120 |
| B | 90.2 | 5.2 | 1.4 | 1.8 | 0.3 | 0.020 | 0.3 | 57.1 | 42.6 | 100 |
| C | 84.8 | 5.3 | 1.5 | 2.5 | 0.8 | 0.029 | 5.1 | 54.0 | 40.9 | 110 |

Sample A: Obtained from bituminous coal (Deashed)
Sample B: Obtained from brown coal (Deashed)
Sample C: Obtained from the same starting material as Sample A (Non-deashed)

From the above, it is noted that the compositions and properties of the three SRC samples closely resemble each other, regardless of the type of starting coal used. This is very advantageous for the purpose of the present invention to obtain high quality caking material from low coalified material.

EXAMPLE 1

The A, B and C SRC samples and two types of additive coals were used to form six SRC-additive coal mixtures. The two additive coals used were weak coking coal D and soft coking coal E, as shown in Table II below:

Table II

Properties of Additive Coal used in Mixing with SRC

| | Moisture (%) | Ash (%) | Volatile matter (%) | Fixed Carbon (%) | CSN | Initial Melting Point (° C) |
|---|---|---|---|---|---|---|
| D coal | 3.1 | 8.0 | 36.0 | 52.9 | 2 | 380 |
| E coal | 1.1 | 6.9 | 40.5 | 51.5 | 3½ | 363 |

The SRC and the additive coal were pulverized into particles of size less than 60 mesh, and then homogeneously mixed in a proportion of 0.5 parts of additive coal per one part of SRC. The resulting mixture was placed in a retort with a side arm, provided with a stirrer, and then heat-treated at 400° C. for 60 minutes therein. During the heat-treatment, gases and low boiling point materials were produced and effused from the retort. The heat-treated material which remained as residue in the retort was recovered as the synthetic coking coal.

The properties of the resulting six synthetic coking coals were examined according to the determining procedure described in JIS M-8801. The results are shown in Table III below. In the table, A', B' and C' are synthetic coking coals which were obtained from the SRC, A, B and C mixed with additive coal D, respectively, and A", B" and C" are ones which were obtained from the A, B and C SRC mixed with additive coal E, respectively.

Table III

| | Properties and Yield of Synthetic Coking Coal | | | | | |
|---|---|---|---|---|---|---|
| | Yield (%) | Fixed Carbon (%) | Volatile Matter (%) | Ash (%) | CSN | Initial Melting Point (° C) |
| A' | 75 | 74 | 22 | 4 | 9 | 310 |
| B' | 77 | 70 | 26 | 4 | 9 | 315 |
| C' | 77 | 69 | 23 | 8 | 9 | 320 |
| A" | 79 | 74 | 23 | 3 | 9 | 300 |
| B" | 76 | 72 | 25 | 3 | 9 | 305 |
| C" | 77 | 68.5 | 24 | 7.5 | 9 | 315 |

As seen from Table 3, the product prepared according to the present invention has much lowered volatile matter and highly enhanced softening point, as compared with the starting SRC. Further, it has CSN (Crusible Swelling Number) of 9 as high.

Cokes were then prepared using the above prepared synthetic coking coals.

Akabira coal having 41% of volatile matter, 50.5% of fixed carbon and 6.6% of ash (soft coking coal produced in Hokkaido, Japan) was employed as a base coal, and this base coal was mixed with 30% by weight of the above prepared synthetic coking coals A', B', C', A", B" and C" to form six coal mixtures. Each mixture was then coked by means of a conventional coking process. Each of the so-obtained coked products had more than 90 of coke strength ($DI_{15}^{30}$). For the purpose of comparison, another coke product was prepared according to the procedure as described above, excepting that Itmann hard coking coal having 18% of volatile matter, 75% of fixed carbon and 6% of ash (produced in Virginia, U.S.A.) was substituted for the synthetic coking coal. The obtained coke had more than 90 of strength ($DI_{15}^{30}$). Further, straight cokes from synthetic coking coal A', said Akahira coal and said Itmann coal employed had 93, 65 and 93 of coke strength ($DI_{15}^{30}$), respectively.

From the above, it is easily seen that the synthetic coking coal prepared according to the present process can be used alone or in combination with other natural coking coal to give a good quality metallurgical coke product. Particularly, it is surprising that the synthetic coking coal prepared according to the present process gives good quality coke comparable to that from the Itmann coal which is a good quality natural coking coal.

In Example 1, the preparation of synthetic coking coal using, as the additive coal, a weak coking coal and a soft coking coal which are lower rank bituminous coals was shown.

According to the present invention, it is also possible to produce good quality coking coal from other low quality additive coals such as non-coking coal.

The following example shows the use of non-coking coal as the additive coal.

EXAMPLE 2

The SRC samples A and C and Taiheiyo coal (non-coking coal produced in Hokkaido, Japan) were used to form synthetic coking coals.

Said Taiheiyo coal had the following properties:

| | |
|---|---|
| Moisture | 7.0% |
| Ash | 7.1% |
| Volatile matter | 41.1% |
| Fixed carbon | 45.5% |

The SRC was pulverized into less than 60 mesh, and the additive coal was pulverized into less than 100 mesh. After the so-pulverized SRC and additive coal were dried, they were homogeneously mixed in a proportion of 0.25 parts of additive coal per one part of SRC, and the resulting mixture was then placed in a retort with side arm, provided with a stirrer and subjected to heat-treatment at 420° C. for 1 hour. During the treatment, gases and low boiling point material were produced and effused out from the retort. The heat-treated product which remained as residue in the retort was recovered as synthetic coking coal.

The properties of the so-obtained two synthetic coking coals were examined according to the procedure described in JIS M-8801. The results are shown in the following Table IV:

Table IV

| | Products | |
|---|---|---|
| | A''' (a) | C''' (b) |
| Yield (%) | 72 | 74 |
| Fixed Carbon (%) | 73 | 65 |
| Volatile Matter (%) | 23.7 | 25.3 |
| Ash (%) | 3.3 | 9.7 |
| CSN | 8 | 8 |
| Initial Melting Point (° C) | 315 | 320 |

(a) : Obtained using SRC sample A.
(b) : Obtained using SRC sample C.

The above Table IV clearly shows that, when non-coking coal which is not thermally melted is used as the additive coal, according to the present invention, there can also be obtained a good coking product having excellent coking properties equivalent or superior to those of natural coking coal.

Then, the above prepared synthetic coking coals A''' and C''' and Taiheiyo coal as a base coal (used in Example I) were used to form cokes according to the procedure as described in Example I. The two cokes obtained had more than 90 of strength ($DI_{15}^{30}$).

We claim:

1. A process for preparing synthetic coking coal which comprises mixing solvent refined coal with at least one coal and heat-treating the mixture at a temperature within a range of from about 300° C. to about 480° C.

2. A process for preparing synthetic coking coal according to claim 1 wherein the heat-treating temperature ranges from about 380° C. to about 450° C.

3. A process for preparing synthetic coking coal according to claim 1 wherein the solvent refined coal and coal are mixed in a proportion of about 1:0.25–4, by weight.

4. A process for preparing synthetic coking coal according to claim 3 wherein the solvent refined coal and coal are mixed in a proportion of about 1:0.5–2, by weight.

5. A process for preparing synthetic coking coal according to claim 1 wherein the heat-treatment is carried out for a time period of about ½ to about 7 hours.

6. A process for preparing synthetic coking coal according to claim 5 wherein the heat-treating time is about 1 to about 2 hours.

7. A process for preparing synthetic coking coal according to claim 1 wherein the coal to be mixed with the solvent refined coal is a coking coal.

8. A process for preparing synthetic coking coal according to claim 7 wherein the coking coal is selected from the group consisting of weak coking coal and soft coking coal.

9. A process for preparing synthetic coking coal according to claim 1 wherein the coal to be mixed with the solvent refined coal is a non-coking coal.

10. A process for preparing synthetic coking coal according to claim 9 wherein the non-coking coal is selected from the group consisting of lignite, brown coal, sub-bituminous coal and anthracite.

* * * * *